United States Patent [19]

Alexander, Jr.

[11] 4,159,742

[45] Jul. 3, 1979

[54] WELL BORE CLEANING TOOL

[75] Inventor: Granison T. Alexander, Jr., New Orleans, La.

[73] Assignee: Chromalloy American Corporation, St. Louis, Mo.

[21] Appl. No.: 864,326

[22] Filed: Dec. 27, 1977

[51] Int. Cl.[2] ..... E21B 37/02

[52] U.S. Cl. ..... 166/173; 166/241

[58] Field of Search ..... 166/173, 241, 172; 15/104.1 R, 104.03, 104.05

[56] References Cited

U.S. PATENT DOCUMENTS

| | | | |
|---|---|---|---|
| 1,623,866 | 4/1927 | Egenhoff | 166/241 X |
| 2,893,494 | 7/1951 | McDuffie | 166/241 |
| 3,072,196 | 1/1963 | Love | 166/241 |
| 3,176,771 | 4/1965 | Claiborne et al. | 166/173 |
| 3,390,725 | 7/1968 | Alexander, Jr. | 166/173 |
| 3,858,653 | 1/1975 | Turbyfill | 166/173 |

*Primary Examiner*—William Pate, III

[57] ABSTRACT

A well bore cleaning tool adapted for attachment to a casing tubing or drill pipe or the like which is to be run into a well bore for cleaning the well bore during reciprocation and/or rotation of the pipe, which includes a plurality of collars adapted to be attached in axially spaced apart fashion to the pipe and lengths of cable connected to and extending between each of the collars, wherein the cables spiral about the pipe in a helical fashion and form a plurality of outwardly bowed helical portions to contact the well bore.

10 Claims, 6 Drawing Figures

FIG. 1
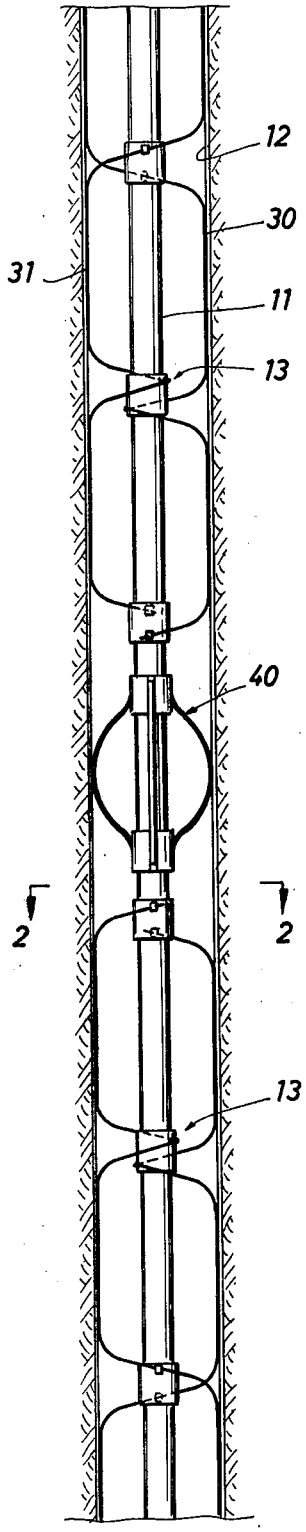
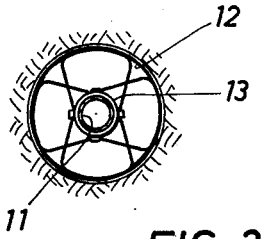
FIG. 2
FIG. 6
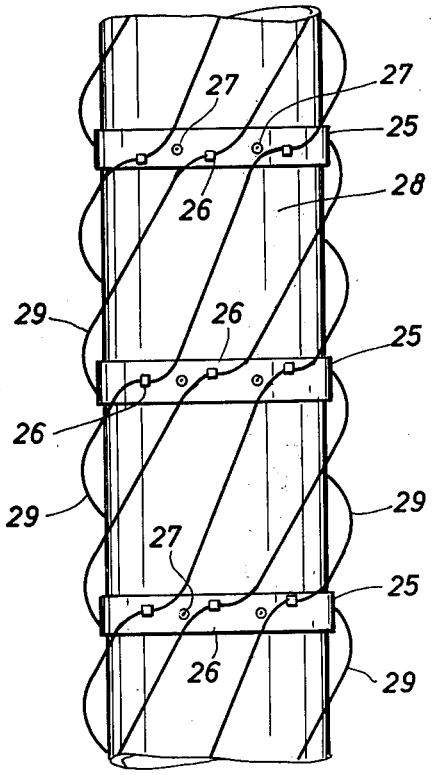

FIG. 3
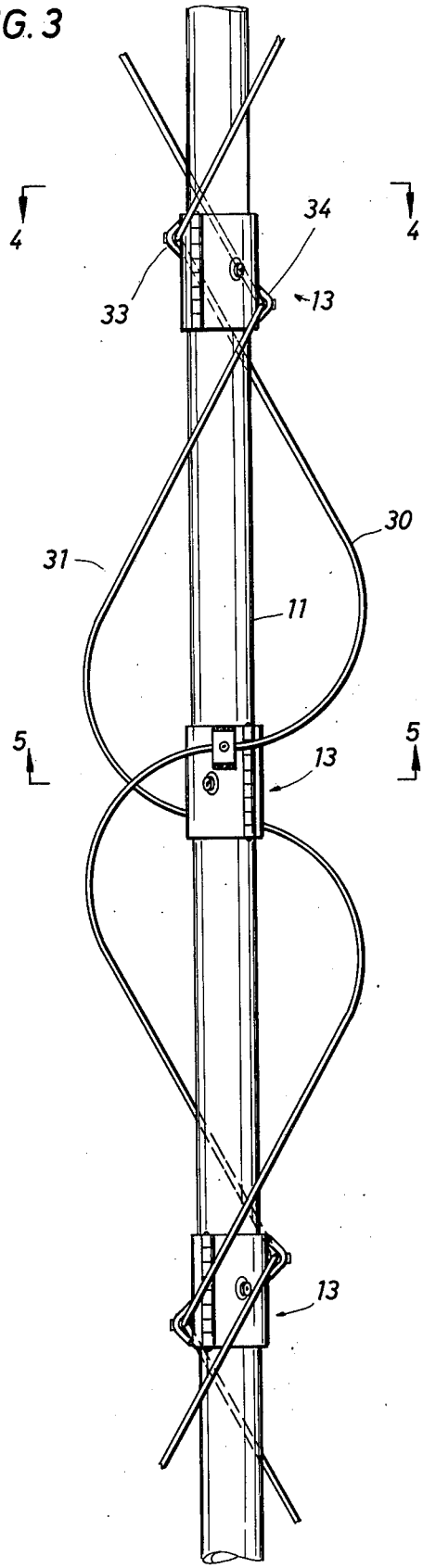
FIG. 4
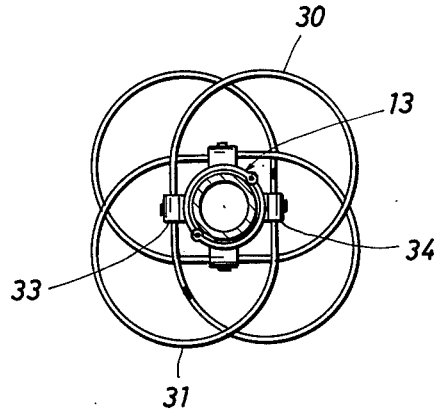
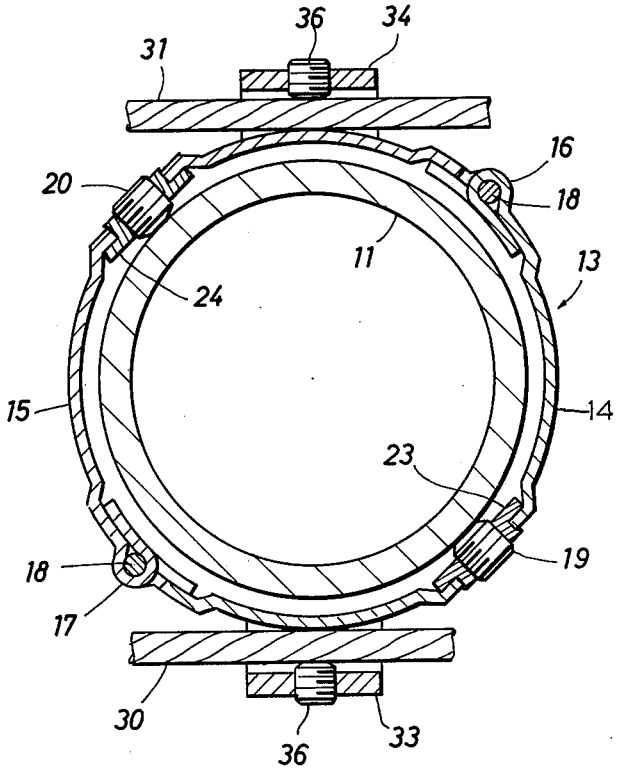
FIG. 5

WELL BORE CLEANING TOOL

BACKGROUND OF THE INVENTION

This invention relates to a well bore cleaning tool for attachment to a well casing or the like, and more particularly to a well bore cleaning tool adapted for cleaning the well bore during reciprocation and/or rotation or the casing or the like.

Description of the Prior Art

At the completion of every oil and gas drilling operation, whether the operation results in production or a dry hole, it is necessary that some cementing be done in the bore hole. In the case of production, the casing must be cemented in the hole for support thereof and prevention of the flow of fluids between formations. In the case of a dry hole, cement plugs must be set at various depths to seal various formations.

When cementing casing, the casing is run into and centered in the hole and then cement is pumped down through the casing to displace the drilling mud from the annulus. When setting a plug, a pipe of relatively small diameter is run into the hole to the depth of the bottom of the plug and cement is pumped through the pipe to displace the mud above the end of the pipe until a plug of sufficient length has been formed at which time the pipe is withdrawn from the hole and the cement is allowed to harden.

In all cases, it is necessary that the walls of the bore hole be cleaned of mud cake and the like so that the cement will bond properly with the formation. Well bore wall cleaning is accomplished by means of devices known as scratchers.

There are two basic types of scratchers: reciprocating and rotating. Reciprocating scratchers are designed to operate when the casing or pipe to which they are attached is moved axially within the bore hole and they usually include a single collar having a plurality of wire bristles or flat loops of wire extending radially therefrom to contact the well bore wall. Another type of reciprocating scratcher is disclosed in U.S. Pat. No. 3,390,725 and includes a pair of collars having a plurality of spiraling wires connecting the collars and a plurality of fingers extending radially outwardly and upwardly from the upper collar. The lower collar is fixed to the casing and the upper collar is free to move axially so that as the casing is run into the bore hole the wires and fingers conform thereto, but as the casing is reciprocated upwardly the fingers thrust the upper collar downwardly into abuttment with the lower collar and spread the wires into a series of flat loops.

Rotating type scratchers are designed to operate when the casing or pipe to which they are attached is rotated and include an axially extending strip having thereon a plurality of radially outwardly extending loops or bristles or a combination of loops and bristles. There is an additional rotating scratcher which includes a helical strip having thereon a plurality of radially outwardly extending bristles.

Reciprocating scratchers clean only when reciprocated and rotating scratchers, with the exception of the helical strip type which cleans to a limited extent while reciprocated, clean only when rotated. However, better cleaning may be otained by a combination of reciprocation and rotation, and no presently existing scratcher is equally well suited for cleaning during reciprocating and/or rotation. An additional shortcoming associated with presently existing rotating scratchers is that the strips upon which the radially outwardly extending loops or bristles is attached have a void space between the strip and the outer surface of the pipe from which mud usually is not displaced. Since the strips extend the entire length of the pipe through the critical zone, there results a vertical channel through the zone, which may cause an ineffective cement job.

SUMMARY OF THE INVENTION

It is therefore an object of the present invention to provide a well bore cleaning tool that will clean equally well during reciprocation and/or rotation. It is a further object of the present invention to provide a well bore cleaning tool that has no axially extending strip that will cause a channel of incomplete cementation.

Briefly stated, the well bore cleaner of the present invention includes a plurality of collars adapted to be attached in axially spaced apart fashion to the casing or pipe to be run into the well bore and lengths of cable connected in axially spaced apart fashion to and extending between each of the collars, wherein the cables spiral about the pipe in helical fashion and form a plurality of outwardly bowed helical portions to contact the well bore. The cables are attached to collars so as to overlap and thereby maximize the coverage during rotation and/or reciprocation.

BRIEF DESCRIPTION OF THE DRAWINGS

FIG. 1 is a side elevation view showing the preferred embodiment of the tool as it would appear in a well bore.

FIG. 2 is a sectional view taken generally along line 2—2 of FIG. 1.

FIG. 3 is a side elevation view showing the preferred embodiment of the tool prior to being run into a well bore.

FIG. 4 is a sectional view taken along line 4—4 of FIG. 3.

FIG. 5 is an enlarged sectional view taken along line 5—5 of FIG. 3 showing details of the construction of the collar.

FIG. 6 is a side elevation view showing an alternate embodiment of the tool of the present invention.

DESCRIPTION OF THE PREFERRED EMBODIMENT

Referring now to the drawings, in FIG. 1, the numeral 11 generally designates a tube, as for example a well casing pipe or the like, and the numeral 23 generally designates a well bore wall. The tool of the preferred embodiment of the present invention includes at least three collars, each designated generally by the numeral 13, having means for attachment thereof to tube 11 in axially spaced apart fashion.

Referring now to FIGS. 3 and 5, each collar 13 includes a pair of halves 14 and 15 connected by a pair of hinges 16 and 17 to form a cylinder having an inside diameter slightly larger than the outside diameter of casing 11. Halves 14 and 15 are hinged together so that collar 13 may be more easily installed about tube 11 by removing the pin 18 from hinge 16 or 17, placing halves 14 and 15 about tube 11, and reinserting pin 18. Of course, collar 13 may also be an unhinged ring, which is well known in the art.

The means for attaching collar 13 to tube 11 conveniently includes a pair of set screws 19 and 20. Set screws 19 and 20 are threadedly engaged in plugs 23 and 24 respectively in halves 14 and 15 respectively. Collar 13 is fixed to tube 11 by screwing set screws 19 and 20 into engagement therewith. Of course, there are many other means for attaching collar 13 to tube 11, all of which are within the scope of the present invention.

The tool of the present invention also includes a pair of cables 30 and 31 that spiral about tube 11 in double helical fashion. Cables 30 and 31 are attached to collars 13 by means of cable guides 33 and 34 respectively to form a plurality of outwardly bowed helical portions extending axially along tube 11 and radially into contact with well bore wall 12.

Cable guides 33 and 34 are attached by welding or the like to halves 14 and 15 of collar 13. Cable guides 33 and 34 are both provided with a set screw 36 threadedly engaged therein to clamp cables 30 and 31 against collar 13. As may be seen in FIGS. 2 and 3, cable guides 33 and 34 are axially spaced apart on collar 13 so that the coverage of cables 33 and 34 tends to overlap in the area adjacent each collar 13 to substantially completely contact well bore wall 12 during rotation of tube 11.

By providing set screws 36, cables 33 and 34 may be removed when they become worn and replaced with new cables. If it is intended that the tool of the present invention be left in a well bore, as for example when used in cementing casing, it may be more economical to fix cables 30 and 31 within cables guides 33 and 34 respectively by welding or the like rather than with set screws 36.

Referring now to FIGS. 3 and 4, each collar 13 is placed on tube 11 such that cable guides 33 and 34 thereof are rotated 90° from those of the collars 13 adjacent thereto. It may also be seen that cables 30 and 31 are run through cable guides 33 and 34 such that between each adjacent set of collars 13, cables 30 and 31 each spiral through an angle relative to the axis of casing 11 substantially equal to 270°. Thus, in the preferred embodiment of the invention, cables 30 and 31 provide effective cleaning during reciprocation of tube 11 when spiralled between at least three collars 13, as shown in FIGS. 2 and 4 and when the length of reciprocation is equal to or greater than the distance between three collars 13.

It should be apparant that a greater or lesser number of cables may be used in a tool within the scope of this invention and that in such tools the points of attachment will be positioned to maximize the coverage of the cables. If the tool of the present invention were used in the cementing of a large diameter casing, more than two cables might be spiralled about the casing. For example, as shown in FIG. 6, which illustrates an alternative embodiment of the present invention, it might be determined that optimum cleaning could be obtained by using six cables instead of two. In such an example, a plurality of collars 25 would be provided, each having six cable guides 26 with means for retaining cables therein, spaced radially equally and axially staggeredly thereabout. Each collar 25 is provided with means, such as set screws 27, for attachment thereof to a pipe 28, which in the present example is a casing, in axially spaced apart fashion. Six lengths of cable 29 are spiralled between collars 25 to form a plurality of outwardly bowed helical portions. In the illustrated example, each cable 29 is spiralled through approximately 120° between each collar 25 to obtain a good rotating and reciprocating coverage. It should of course be recognized that each cable 29 could be spiralled through a greater number of degrees.

As an example of the use of the tool of the present invention, it will be assumed that the tool of the preferred embodiment of the present invention is used to clean the well bore walls during the setting of a plug. In such a situation, tube 11 would be known as a stinger and would be a pipe of relatively small outside diameter compared to the diameter of the well bore, such as drill pipe or the like. A plurality of collars 13 are installed on tube 11 in axially spaced apart fashion such that cable guides 33 and 34 thereof are 90° apart. Cables 30 and 31 are then run through cable guides 33 and 34 respectively such that between each collar 13 each cable spirals through an angle substantially equal to 270° relative to the axis of tube 11. Cables 30 and 31 are fixed within wire guides 33 and 34 respectively by means of set screws 36. Collars 13 and cables 30 and 31 are spaced and run along tube 11 so as to substantially cover a length of tube 11 as long as the plug to be set. Centralizers 40 may be installed upon tube 11 at periodic intervals in order to center tube 11 within the well bore. Tube 11 is then run into the well bore to a depth such that the bottom end thereof coincides with the desired bottom point of the plug, at which point tube 11 may be either reciprocated or rotated or both to effectively clean well bore wall 12. After well bore wall 12 has been cleaned, cement is forced through the inside of tube 11 and into the annulus between tube 11 and well bore wall 12 to displace the mud upwardly therefrom. After a sufficient amount of cement has been pumped into the hole, tube 11 may be removed therefrom.

If after the tool of the present invention has been used in a number plug setting operations cables 30 and 31 become worn, they may be replaced with new cables.

As another example of the use of the tool of the present invention, it will be assumed that the tool of the present invention is used to clean well bore wall 12 during the cementing of casing. In this situation, tube 11 would represent a casing and a plurality of collars would be installed in spaced apart fashion thereon such that the formations requiring isolation plus a reasonable amount of overlap above the below formation would be covered. Collars 13 are installed on tube 11 such that cable guides 33 and 34 thereof are 90° apart. Cables 30 and 31 are then run through cable guides 33 and 34 respectively such that between each collar 13 each cable spirals through an angle substantially equal to 270° relative to the axis of tube 11. Cables 30 and 31 are then run through cable guides 33 and 34 respectively such that between each collar 13 each cable spirals through an angle substantially equal to 270° relative to the axis of tube 11. Cables 30 and 31 are then fixed within wire guides 33 and 34 respectively by means of set screws 36, welding or by crimping or clamping within wire guides 33 and 34. Again, centralizers 40 may be installed at periodic intervals on tube 11 to center tube 11 within the well bore. Tube 11 is then run into the well bore and reciprocated or rotated or both to effectively clean well bore wall 12 during the cementation thereof. After the mud within the annulus between tube 11 and well bore wall 12 has been displaced by cement, the cement is allowed to set therein.

In the casing cementing example a further advantage of the tool of the present invention over prior art scratchers is obtained. Cables 33 and 34 remain within the well bore after the cement is set and thus more effectively reinforce the cement than do prior art scratchers. Cables 33 and 34 run the substantially entire length of and completely encircle tubing 11 within the critical zones and thus greatly reinforce the cement in the annulus. This reinforcement makes the cement much less likely to shatter during the perforation thereof.

Further modifications and alternative embodiments of the apparatus of this invention will be apparent to those skilled in the art in view of this description. Accordingly, this description is construed as illustrative only and is for the purpose of teaching those skilled in the art the manner of carrying out the invention. It is to be understood that the forms of the invention herewith shown and described are to be taken as the presently preferred embodiment. Various changes may be made in the shape, size, number and arrangement of parts. For example, equivalent elements or materials may be substituted for those illustrated and described herein, parts may be reversed, and certain features of the invention may be utilized independently of the use of other features, all as would be apparent to one skilled in the art having the benefit of this description of the invention.

What is claimed is:

1. A well bore cleaning tool adapted for attachment to a casing pipe or the like which is to be run into said well bore, comprising:

a pair of cables;

means for attaching said cables to said pipe at a plurality of axially spaced apart points to form a double helix about said pipe, said helix including a plurality of segments outwardly bowed from said pipe, wherein said segments extend outwardly from said pipe to substantially completely contact the walls of said well bore during rotation and reciprocation of said pipe.

2. The well bore cleaning tool as claimed in claim 1, wherein said attaching means includes:

a collar having an inside diameter substantially equal to the outside diameter of said pipe;

means for attaching said collar to said pipe;

and means for fixing said cables at axially spaced apart points on said collar.

3. The well bore cleaning tool as claimed in claim 2, wherein said fixing means includes:

a pair of cable guides attached at axially spaced apart points on said pipe;

and means for retaining said cables within said wire guides.

4. The well bore cleaning tool as claimed in claim 3, wherein said retaining means includes set screw means for clamping said cables against said collar.

5. A well bore cleaning tool adapted for attachment to a tube which is run into said well bore, comprising:

at least three collars adapted for attachment in axially spaced apart fashion to said tube;

and a plurality of cables, wherein each of said cables is connected in axially spaced apart fashion to and extending between each of said collars, and wherein said cables spiral about said tube in helical fashion and form a plurality of outwardly bowed helical portions to substantially completely contact said well bore during rotation and reciprocation of said tube.

6. A well bore cleaning tool comprising:

a plurality of collars adapted to be attached in axially spaced apart fashion to a tube run into said well bore;

and a pair of cables connected in axially spaced apart fashion to and extending between each of said collars, wherein said cables spiral about said tube in double helical fashion and form a plurality of outwardly bowed helical portions to contact said well bore.

7. The well bore cleaning tool as claimed in claim 6, wherein:

said cables are connected to opposite sides of said collars.

8. The well bore cleaner as claimed in claim 6, wherein:

between each of said collars, each of said cables spirals through an angle relative to the axis of said pipe substantially equal to 270°.

9. A well bore cleaning tool comprising:

at last three collars adapted for attachment in axially spaced apart fashion to a tube to be run into said well bore, each of said collars including a pair of cable guides attached in axially spaced apart fashion on substantially diametrically opposite sides thereof;

a pair of cables running through said cable guides to form a double helix about said tube, said double helix including a plurality of outwardly bowed helical portions to contact said well bore;

and means for fixing said cables in said wire guides.

10. The well bore cleaning tool as claimed in claim 9, wherein:

between each of said collars, each of said cables spirals through an angle relative to the axis of said tube substantially equal to 270°.

* * * * *